US008608575B2

(12) United States Patent
Waldock et al.

(10) Patent No.: US 8,608,575 B2
(45) Date of Patent: Dec. 17, 2013

(54) CONTAINER AND ELECTRONIC GAME SYSTEM COMPRISING SUCH CONTAINER

(75) Inventors: Ian Waldock, Southampton (GB); Nick Thorne, Southampton (GB)

(73) Assignee: NXP B.V., Eindhoven (NL)

( * ) Notice: Subject to any disclaimer, the term of this patent is extended or adjusted under 35 U.S.C. 154(b) by 328 days.

(21) Appl. No.: 13/059,211

(22) PCT Filed: Jul. 30, 2009

(86) PCT No.: PCT/IB2009/053315

§ 371 (c)(1),
(2), (4) Date: Apr. 29, 2011

(87) PCT Pub. No.: WO2010/018483

PCT Pub. Date: Feb. 18, 2010

(65) Prior Publication Data

US 2011/0201432 A1 Aug. 18, 2011

(30) Foreign Application Priority Data

Aug. 15, 2008 (EP) ..... 08105051

(51) Int. Cl.

| | |
|---|---|
| ***A63F 9/24*** | (2006.01) |
| ***A63F 13/00*** | (2006.01) |
| ***G06F 17/00*** | (2006.01) |
| ***G06F 19/00*** | (2011.01) |

(52) U.S. Cl.
USPC ..... 463/46; 463/36; 340/572.1; 340/5.73; 206/315.1

(58) Field of Classification Search
USPC ..... 340/572.1, 5.72, 5.73, 5.7, 5.65; 463/46, 36, 1; 206/315.1
See application file for complete search history.

(56) References Cited

U.S. PATENT DOCUMENTS

| | | | | |
|---|---|---|---|---|
| 6,873,248 | B2 * | 3/2005 | Ott | 340/5.72 |
| 7,474,200 | B2 * | 1/2009 | Ogino et al. | 340/426.16 |
| 8,058,971 | B2 * | 11/2011 | Harkins et al. | 340/5.73 |
| 8,089,342 | B2 * | 1/2012 | Sugiura et al. | 340/5.72 |
| 2006/0082436 | A1 * | 4/2006 | Kamiya et al. | 340/5.72 |
| 2006/0139147 | A1 * | 6/2006 | Sterzinger et al. | 340/5.72 |
| 2006/0279402 | A1 * | 12/2006 | Okamitsu et al. | 340/5.62 |
| 2008/0139317 | A1 * | 6/2008 | Sheikh | 463/42 |
| 2008/0246587 | A1 * | 10/2008 | Fisher | 340/5.73 |

FOREIGN PATENT DOCUMENTS

| | | | |
|---|---|---|---|
| EP | 1632410 | A1 * | 3/2006 |
| WO | WO 2006039339 | A2 * | 4/2006 |

* cited by examiner

*Primary Examiner* — Eric M Blount

(57) ABSTRACT

A container (100) is disclosed comprising a compartment (110); a controller (120) for controlling access to the compartment (110); a near-field communication device (130) for providing the controller (120) with identification information, said controller (120) being responsive to said identification information, wherein the near-field communication device (130) comprises a plurality of antennae (132), each of said antennae being accessible in a different surface area of the container (100). The container (100) may be used in games using near-field communication (NFC) technology, such as a NFC-based version of pass the parcel. An electronic game system (300) comprising such a container and a game controller (200) for use in such an electronic game system (100) are also disclosed.

15 Claims, 3 Drawing Sheets

CONTAINER AND ELECTRONIC GAME SYSTEM COMPRISING SUCH CONTAINER

FIELD OF THE INVENTION

Figure 1:
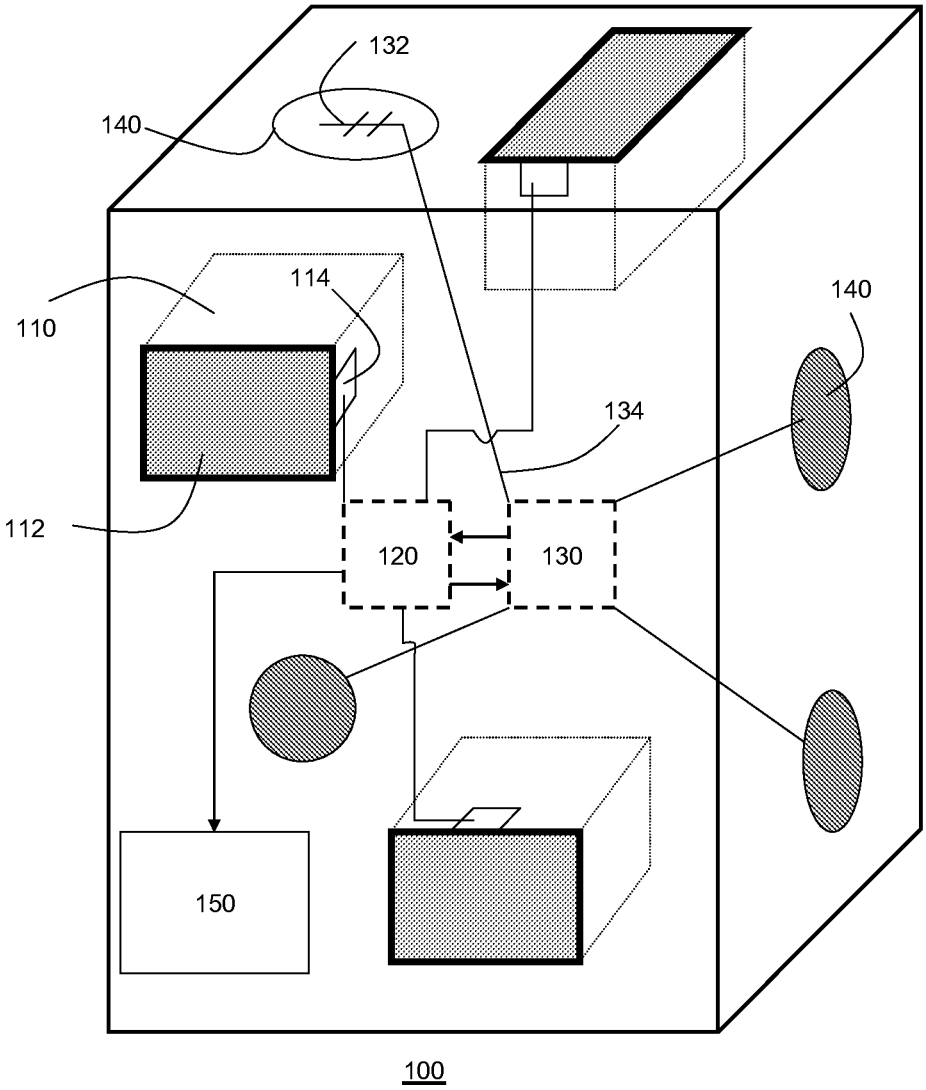

The present invention relates to a container comprising a compartment and a controller for controlling access to the compartment.

The present invention further relates an electronic game system comprising such a container.

BACKGROUND OF THE INVENTION

Electronic games are nowadays commonplace. Originally, electronic games were mainly developed in the shape of dedicated programs for execution on games consoles or personal computers, but the reduction in cost of electronic components due to ongoing technological advances, e.g. miniaturization, in the field of semiconductor technology have made the manufacture of dedicated electronic games economically feasible.

This development has led to a redevelopment of several children's games and board games in an electronic shape. An example of an electronic version of such a game can be found on the Internet:

http://www.comparestoreprices.co.uk/kids-games/unbranded-pass-the-parcel-electronic-game.asp discloses an electronic version of the popular pass-the-parcel game, in which a container with a locked lid is passed around until the lid is released and prizes and/or treats may be retrieved from inside the container. The lid is opened either by random termination of a melody played by the container or by remote control. A drawback of this electronic game is that the players of the game have little control over unlocking the locked container. This makes the game rather one-dimensional, and therefore less appealing for older game players, such that the target market of this game is predominantly limited to (young) children.

SUMMARY OF THE INVENTION

The present invention seeks to provide a container for use in an electronic game that allows for increased control over opening the container.

The present invention further seeks to provide an electronic game system comprising such a container.

The present invention yet further seeks to provide a game program product and a game controller for use in such an electronic game system.

According to a first aspect of the present invention, there is provided a container comprising a compartment; a controller for controlling access to the compartment; a near-field communication device for providing the controller with identification information, said controller being responsive to said identification information, wherein the near-field communication device comprises a plurality of antennae, each of said antennae being accessible in a different surface area of the container.

Such a container, which may comprise a door for providing access to the compartment, said door comprising a locking mechanism responsive to the controller, may be configured, e.g. programmed to provide different ways in which access to the compartment is granted, thereby enhancing the complexity of the game. Moreover, the game player may use a game controller to gain access to the compartment by establishing a communicative contact with one of the antennae selected by the game player, thus enhancing the impression of control over the outcome of the game.

To this end, each of said surface areas may comprise a surface marking to individualize each area, such that a game player is provided with the impression that a conscious selection of such a surface area has to be made.

In an embodiment, the near field communication device is configurable such that the near field communication device is responsive to selected antennae only. This introduces the appealing random nature of gaining access to the compartment because a particular surface area that was addressed by one player and failed to unlock the compartment, may suddenly become active for the next player, such that it is not possible for a subsequent player to rule out certain surface markings based on a previous unsuccessful attempt to unlock the compartment. In an embodiment, the controller is arranged to periodically alter the configuration of the near field communication device.

In a further embodiment, the container further comprises at least one of a loudspeaker and a display screen for providing instructions to a user of the container. Such instructions may for instance comprise the performance of some activity or the instruction to solve a puzzle or riddle with the outcome of the puzzle or riddle giving a clue as to which surface marking should be accessed to open the compartment.

The controller may also be arranged to provide access to the compartment after the provision of the instructions to the user, e.g. after a predefined delay or after a confirmation from another game player that the instructions have been carried out.

The container of the present invention is not limited to a single compartment. In an embodiment, wherein the container comprises a plurality of compartments, and wherein the controller is arranged to provide access to individual compartments. For instance, different compartments may be accessible in different ways, e.g. by means of different identification codes or by accessing different antennae.

In an embodiment, the controller is further arranged to keep a record of the identification information triggering access to one of said compartments. This may be used to ensure that rewards hidden in the compartments are equally shared between game participants or to increase the number of rewards for a special game participant, e.g. a player celebrating his or her birthday.

According to a further aspect of the present invention, there is provided an electronic game system comprising the container of the present invention and at least one game controller for providing the near-field communication device with an identification code. Multiple game controllers each providing unique identification codes may be provided. The game controllers may be programmable, such that the identification codes can be configured, e.g. a name of a game participant may be used as an identification code.

The at least one game controller may comprise a radio-frequency identification tag for generating the identification code in response to a radio signal from the near-field communication device. This has the advantage that the game controller does not require a power supply for generating the identification code. Alternatively, the at least one game controller may be an active device comprising a further near field communication device for generating the identification code in response to an established communication with the near-field communication device.

In an embodiment, the at least one game controller comprises a processor for executing a computer game program, wherein during execution of said game computer program, an event in said game triggers the generation of the identification code. This has the advantage that the play of a computer game or video game may be enhanced with the reward of prizes stored in the container. For instance, the game program may contain a game scenario in which a key may be retrieved, which may be used to open one of the compartments of the container. To this end, the processor may be arranged to program an identification code into the RF communication part of the game controller such that the code may be communicated to the container.

According to a yet further aspect of the present invention, there is provided a computer game program product for use in the electronic game system of the present invention, said program product being adapted to, when executed on the processor of one of the game controllers, trigger the generation of the identification code in response to the occurrence of a game event. Such a program facilitates the interaction of such a game controller with the container of the present invention.

According to a yet further aspect of the present invention, there is provided a game controller for use with the container of the present invention, said controller being arranged to provide the near-field communication device with an identification code, wherein the game controller comprises a processor and a computer game program for, when executed on said processor, triggering the generation of the identification code in response to an event occurring in the game. Such a game controller facilitates the interaction between a game executed on its processor and the container of the present invention.

BRIEF DESCRIPTION OF THE EMBODIMENTS

Figure 2:
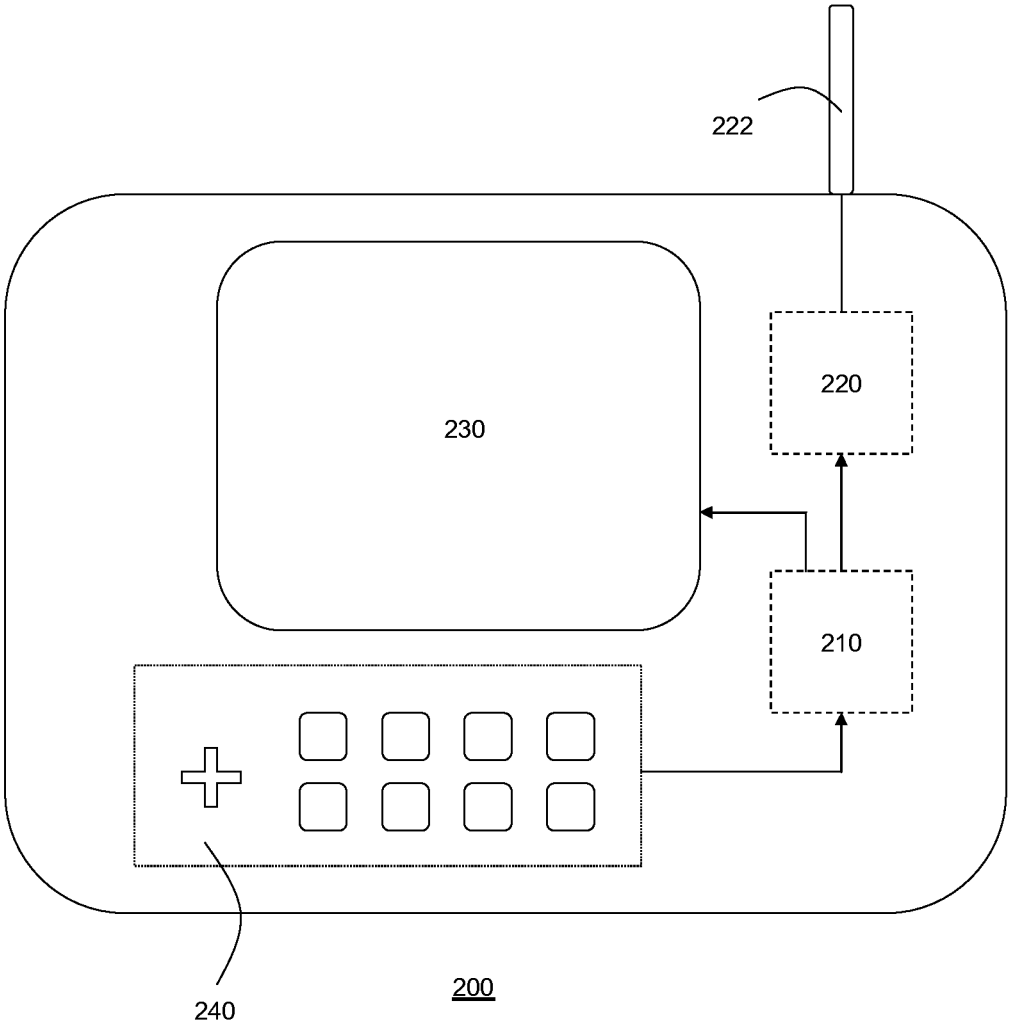
Figure 3:
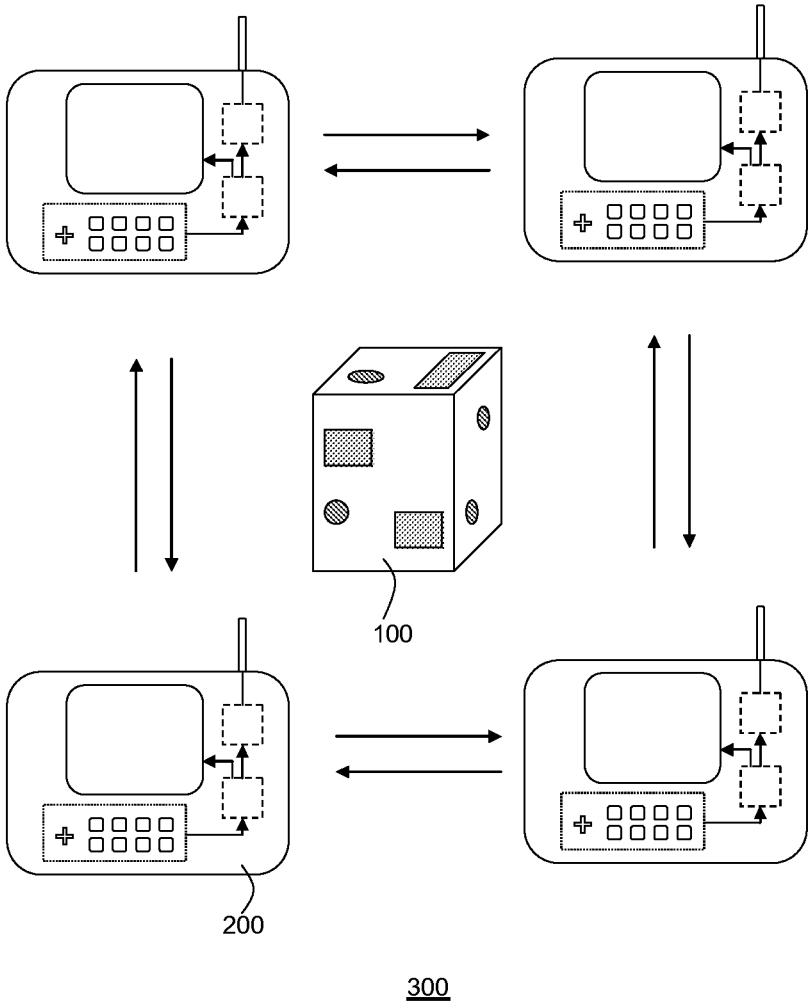

Embodiments of the invention are described in more detail and by way of non-limiting examples with reference to the accompanying drawings, wherein:

FIG. 1 schematically depicts a container in accordance with an embodiment of the present invention;

FIG. 2 schematically depicts a game controller in accordance with an embodiment of the present invention; and FIG. 3 schematically depicts an electronic game system in accordance with an embodiment of the present invention.

DETAILED DESCRIPTION OF THE DRAWINGS

It should be understood that the Figures are merely schematic and are not drawn to scale. It should also be understood that the same reference numerals are used throughout the Figures to indicate the same or similar parts.

FIG. 1 shows an embodiment of a container 100 according to the present invention. The container 100 comprises a number of compartments 110, which are closed by a lid or door 112 and kept closed by a locking mechanism 114. In FIG. 1, three compartments 110 are shown by way of non-limiting example only. It should be understood that the container 100 may have any number of compartments 110, even a single compartment.

The container 100 further comprises a controller 120 for controlling the individual locking mechanisms 114 such that the controller 120 may provide access to an individual compartment 110 when a predefined access condition has been met.

The container 100 further comprises a near-field communication (NFC) device 130, which comprises a plurality of antennae 132 each located near the surface of the container 100 in different surface areas. Each surface area comprising an antenna 132 may be marked by a surface marking 140 such that a player of a game involving the container 100 can easily identify the location of an antenna 132. In FIG. 1, four of such areas 140 marking the location of antennae 132 are shown by way of non-limiting example only. It should be understood that the container 100 may comprise any number of antennae 132. Also, it should be understood that any suitable surface markings 140 may be used. For instance, different markings 140 may have the same or different shapes and/or the same or different appearances.

The NFC device 130 may be any suitable device for establishing a communicative contact with a RF signal source such as a RF-ID tag or another NFC device. To this end, the antenna 132 may be arranged to both transmit and receive radio signals. Hence, when establishing a communicative connection with a passive RF-ID tag, the antenna 132 is capable of transmitting the radio signal generated by the NFC device 130, as well as receiving the response signal from the RF-ID tag induced by the radio signal from the NFC device 130. In an embodiment, the signal strength of the radio signal generated by the NFC device 130 is typically such that two spatially separated antennae 132 cannot simultaneously establish a communicative contact with an external RF signal source.

The NFC device 130 is arranged to forward data received from a RF signal source to the controller 120. Such data may for instance be data for identifying the RF signal source, such as an identification code. The controller 120 decides on the basis of this data whether or not to release one of the locking mechanisms 114 such that the person associated with this data may gain access to the corresponding compartment 110.

In an embodiment, the container 100 further comprises one or more output devices 150 such as a loudspeaker and/or a display screen under control of the controller 120. The one or more output devices may be used to give a user of the container 100, e.g. a participant in a game involving the container 100, instructions, which when completed may give the user access to one of the compartments 110 or at least provide the user with clues of how to access one or more of the compartments 110. In case of a display screen, the controller 120 may be arranged to provide compartment access information on the display screen, such as the identification code and access time of the most recent access to one of the compartments 110.

In an embodiment, not all antennae 132 are active at the same time, such that a user of the container 100, e.g. a game participant in an electronic game involving the container 100, is not guaranteed to establish a communicative contact with the NFC device 120 by approaching one of the surface markings 140 with a RF signal source such as a passive RF-ID tag integrated in a holder such as a wand, bracelet or other type of game controller. The NFC device 130 may be configured to periodically select a different subset of antennae 132 to 'randomize' the active antennae 132 for the game participants. The NFC device 130 may for instance be triggered to alter the antenna selection after a predefined period of time or after a successful communication has been established with an external RF signal source.

Alternatively, the controller 120 may configure the antenna selection of the NFC device 130. To this end, the controller 120 may provide the NFC device 120 with antenna selection configuration data. Alternatively, the connections 134 to the antennae 132 may each comprise a switch (not shown) controlled by the controller 120 such that the controller 120 may select antennae 132 by setting the switches to an appropriate state.

In a further embodiment, the controller 120 may be configurable such that identification codes may be programmed into the controller 120, e.g. by means of communication through the NFC device 120 or by means of another input device (not shown) such as a keypad. This allows the use of personalized identification codes, e.g. names, in a game involving the container 100.

The controller may be responsive to a further identification code, e.g. a master instruction, for releasing all locking mechanisms 114. This is for instance useful for granting access to all the compartments 110 to a game organizer, e.g. a parent, such that the compartment may be loaded with prizes or other incentives prior to commencing a game involving the container 100.

The rules on which the controller 120 decides to grant access to one of the compartments 110 are not essential to the present invention, and many alternatives will be apparent to the skilled person.

For instance, the container 100 may be used in a traditional pass-the-parcel game, where multiple game participants may pass the container 100 between them and try to open one of the compartments 100 by approaching one of the surface markings 140 with his or her RF signal source-comprising game controller such as a wand with integrated RF-ID tag or the like. Access to one of the prizes may be given when a game participant approaches an active antenna 132 such that an identification code is successfully retrieved from the RF signal source by the NFC device 130.

The controller 120 may keep track of which game participant has won a prize such that prizes may be evenly distributed over the game participants. This may for instance be realized by storing an identification code in a data storage device such as a memory or a look-up table when a prize is awarded, i.e. access is granted to one of the compartments 110, to the corresponding game participant. The controller 120 may be programmed to award more prizes to some of the game participants, e.g. a participant celebrating his or her birthday. Similarly, special prizes may only be made available to some of the game participants. The controller 120 may be pre-programmed accordingly, e.g. by specifying per game participant how many prizes may be won or by linking certain compartments 110 with selected game participants such that only selected game participants may open such compartments 110. In another example, the controller 120 may be configured to grant access to a selected one of the compartments 110 only after all other compartments 110 have been successfully opened. This selected compartment 110 may be used to store a special prize. Many other variations will be apparent to the skilled person.

Access to a compartment may also be granted using more complex routines. For instance, upon successfully approaching an active antenna 132, a game participant may be given additional instructions, e.g. through an output device 150, which must be followed before access to a compartment 110 is granted, such as 'jump ten times' 'run a lap around a laid out course' and so on. Such instructions may be programmed into the controller 120 by the organizer of the game, and may be adapted based on the age of the game participants. For instance, the instructions may be adapted to be experienced as entertaining by adults.

The controller 120 may be configured to assume that the given instructions are always followed, such that access to a compartment 110 may be granted after a predefined time period. Alternatively, the controller 120 may be configured to expect a confirmation from another game participant that the instructions have been followed. This confirmation may for instance be provided by the other game participant forwarding his or her identification code to the NFC device 130 by means of a communicative contact between the NFC device 130 and the RF signal source dedicated to the game participant.

In an alternative embodiment, access to one of the compartments 110 may be granted if the game participant successfully accesses a predefined sequence of antennae 132. For instance, the output device 150 may provide the game participant with a puzzle or quiz, to which the answers are given by accessing the antennae 132 in a certain sequence. If the certain sequence corresponds to the predefined sequence, access may be granted to one or more of the compartments 110. The surface markings 140 may be used to identify sequence options such as potential quiz answers, e.g. by labeling them 'A', 'B', 'C', and 'D' in case of a multiple choice quiz.

In yet another embodiment, a game participant will have to unlock an identification code in a game program executing on a game controller, which may require help from other game participants. FIG. 2 shows an embodiment of such a game controller 200. The game controller comprises a processor for executing a game program product. The processor is arranged to provide a display screen 230 with content from the game program product and is responsive to game controls 240, which typically provide user-selected game commands to influence the execution trace of the game program product. These are well-known elements of a game controller, e.g. a games console, and will not be described in further detail for reasons of brevity only. The game program product may be provided separately, e.g. on a suitable data carrier such as CD-ROM, DVD, memory stick, Internet server and so on, in which case the game controller may have a reader (not shown) for reading the data carrier. The game controller 200 further comprises a RF signal source 220 coupled to an antenna 222 for communicating with the NFC device 130 of the container 100. The RF signal source 220 may be a RF-ID tag or another NFC device.

The game program product may have one or more identification codes embedded, i.e. hidden, in the game, which may be uncovered during playing the game, e.g. by the intended execution of a game scenario, e.g. by a player finding an object such as a key in a treasure hunt or adventure game. The processor 210 is arranged to forward such an uncovered identification code to the RF signal source 220 such that the player using the game controller 200 may approach one of the antennae 132 of the container 100 to access one of the compartments 110. The compartment 110 may for instance contain a prize or a clue for progressing in the game. In an embodiment, the processor 210 is arranged to generate a message on the display screen 230 to notify the player that an identification code has been uploaded into the RF signal source 220. The user may generate the transmission of the uncovered identification code to the container 100 by establishing a communicative contact between the RF signal source 220 and the NFC device 130 via one of the antennae 132, as previously explained.

The electronic game system of the present invention typically comprises the container 100 and at least one game controller, which may be as simple as a single RF-ID tag embedded in an object or may be a games console 200 as shown in FIG. 2. In an embodiment, as shown in FIG. 3, an electronic game system 300 comprises the container 100 and a plurality of game controllers 200, which are adapted for wireless communication which each other. During game play, all game controllers 200 execute the same game program product, where the game players may perform a shared task which requires the periodical passing of the container 100 from one game participant to another. In other words, the participants may have to take turns to perform a task requiring multiple turns to complete, with the participant whose turn it is having control over the container 100. The wireless communication between the game consoles 200 ensures that each participant is kept updated about the state or progress of the shared task. Upon completion of the task, a compartment 110 may be opened by the participant controlling the container 100. Alternatively, the controller 120 may be triggered to open a compartment after a random delay following the completion of the task. For instance, the participants may play a pet game in which a dog is required to chew a bone. Once the bone is consumed, or at least chewed down by a certain amount, access may be granted to a compartment as described above.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A container for an electronic game system comprising:
a compartment;
a controller for controlling access to the compartment;
a near-field communication device for providing the controller with identification information, said controller being responsive to said identification information, wherein the near-field communication device comprises a plurality of antennae, each of said plurality of antennae being accessible in a different surface area of the container.

2. The container of claim 1, wherein the container comprises a door for providing access to the compartment, said door comprising a locking mechanism responsive to the controller.

3. The container of claim 1, wherein each of said surface areas comprises a surface marking.

4. The container of claim 1, wherein the near field communication device is configurable such that the near field communication device is responsive to selected antennae only.

5. The container of claim 4, wherein the controller is arranged to periodically alter the configuration of the near field communication device.

6. The container of claim 1, further comprising at least one of a loudspeaker and a display screen for providing instructions to a user of the container.

7. The container of claim 6, wherein the controller is arranged to provide access to the compartment after the provision of the instructions to the user.

8. The container of claim 1, wherein the container comprises a plurality of compartments, and wherein the controller is arranged to provide access to individual compartments.

9. The container of claim 8, wherein the controller is further arranged to keep a record of the identification information triggering access to one of said compartments.

10. An electronic game system comprising a container having:
a compartment;
a controller for controlling access to the compartment;
a near-field communication device for providing the controller with identification information, said controller being responsive to said identification information, wherein the near-field communication device comprises a plurality of antennae, each of said antennae being accessible in a different surface area of the container, the system further comprising at least one game controller for providing the near-field communication device with an identification code.

11. The electronic game system of claim 10, wherein the at least one game controller comprises a radio-frequency identification tag for generating the identification code in response to a radio signal from the near-field communication device.

12. The electronic game system of claim 10, wherein the at least one game controller comprises a further near field communication device for generating the identification code in response to an established communication with the near-field communication device.

13. The electronic game system of any of claim 10, wherein the at least one game controller comprises a processor for executing a computer game program, wherein, during execution of said computer game program, an event in said game triggers the generation of the identification code.

14. A game computer program product for use in the electronic game system of claim 13, adapted to, when executed on said processor, trigger the generation of the identification code in response to the occurrence of a game event.

15. A game controller for use with the container of claim 1, arranged to provide the near-field communication device with an identification code, wherein the game controller comprises a processor and a computer game program for, when executed on said processor, triggering the generation of the identification code in response to an event occurring in the game.

* * * * *